United States Patent [19]

Davis

[11] Patent Number: 4,629,651

[45] Date of Patent: Dec. 16, 1986

[54] TWO PHASE HARDY FABRIC FINISH

[75] Inventor: Delbert A. Davis, Kernersville, N.C.

[73] Assignee: Burlington Industries, Inc., Greensboro, N.C.

[21] Appl. No.: 797,849

[22] Filed: Nov. 14, 1985

[51] Int. Cl.[4] ..... B05D 1/36; B32B 7/00; B32B 7/08; B32B 27/32

[52] U.S. Cl. ..... 428/247; 156/93; 156/307.7; 206/524.2; 206/524.3; 220/DIG. 11; 405/16; 405/17; 405/284; 427/412; 428/36; 428/102; 428/286; 428/519

[58] Field of Search ..... 156/93, 307.7; 206/524.2, 524.3, DIG. 819; 220/DIG. 11; 405/16, 17, 284; 427/412; 428/36, 102, 247, 286, 519

[56] References Cited

U.S. PATENT DOCUMENTS

| | | | |
|---|---|---|---|
| 2,502,353 | 3/1950 | Sullivan . | |
| 3,067,484 | 12/1962 | Rasero et al. . | |
| 3,502,537 | 3/1970 | Pearson et al. . | |
| 3,600,268 | 8/1971 | Hori et al. . | |
| 3,702,785 | 11/1972 | Knechtges et al. . | |
| 4,105,819 | 8/1978 | Kotcharian . | |
| 4,205,559 | 6/1980 | Long et al. . | |
| 4,233,356 | 11/1980 | Jacobs | 428/247 |
| 4,378,403 | 3/1983 | Kotcharian . | |
| 4,435,466 | 3/1984 | Kuhnel | 428/247 |
| 4,548,859 | 10/1985 | Kline et al. | 428/247 |
| 4,562,103 | 12/1985 | Hering | 428/76 |

FOREIGN PATENT DOCUMENTS 1432619 4/1976 United Kingdom .

OTHER PUBLICATIONS

Fernando, et al. "Vulcanizing Systems for Low Temperature and and Sunlight Curing . . . ", 1978.

Daily News Record, Feb., 1985, p. 16, "New Allied Polyethylene Fiber . . . ".

"The Neoprenes" by Murray et al., pp. 2, 3, 6, 7, 28, 29, 40, 41, 58, 62, 63, 74, 83, 84, 100, and 101.

"Introduction to Rubber Technology" by Morton, pp. 113 through 125.

*Primary Examiner*—James C. Cannon

*Attorney, Agent, or Firm*—Nixon & Vanderhye

[57] ABSTRACT

A treated fabric is constructed that is capable of withstanding extremely harsh weather and abrasion conditions in low temperature environments. The treated fabric comprises a woven or weft inserted warp knit synthetic fiber fabric which has a generally open construction and is pretreated with a chemical bonding agent to facilitate adhesion of a neoprene coating to the fabric. A neoprene, such as neoprene AD, having a highly crystalline structure and including effective amounts of low temperature plasticizers, antioxidants, and loadings, is applied to the fabric, and it is coated with a highly crystalline acrylic coating. The neoprene coating vulcanizes (cures) in use, such as when used as a geotextile fabric, the highly crystalline acrylic coating protecting the neoprene until it vulcanizes. The fabric may be attached to a nonwoven filter fabric, and formed into a bag which is filled with sand, grout, or the like during actual use of the geotextile fabric in the harsh environment.

20 Claims, 3 Drawing Figures

TWO PHASE HARDY FABRIC FINISH

BACKGROUND AND SUMMARY OF THE INVENTION

There are many exceptionally savage environments in which geotextile fabrics are utilized that result in quick destruction of the geotextile fabrics. For instance, in the use of geotextile fabrics to form bags that are filled with sand, grout, or the like for use on the Alaskan Slope, or in other harsh weather, abrading, and low temperature environments, geotextile fabrics often have a short life. This can pose a significant impediment to construction, drilling, and like activities. Therefore it is desirable to be able to provide a geotextile fabric that can withstand such a harsh environment over long periods of time.

According to the present invention, a treated fabric is provided which exhibits excellent abrasion, impact, ultraviolet light, and water resistance. The treated fabric exhibits these desirable properties to such an extent that it can be utilized in harsh low temperature environments for periods on the order of 25 years.

According to one aspect of the present invention, a treated fabric is provided which comprises a fabric of a synthetic material with a generally open construction, and first and second highly crystalline finishes. The fabric preferably is a woven or weft inserted warp knit fabric, formed of polyamide, polyester, super polyolefin (e.g. super polyethylene, super polypropylene) or aramid fibers. A chemical bonding agent, such as isocyanate resin, can be utilized to facilitate adhesion of the first highly crystalline coating to the synthetic fibers of the fabric. The first highly crystalline coating comprises a neoprene, such as neoprene AD, AC, CG, W, WHV, FC, HC, or GRT, which preferably has effective amounts of low temperature plasticizers (such as butyl oleate), antioxidants (such as octamine), or loadings (such as clay). Other materials may also be present. The second coating comprises an ablative highly crystalline acrylic material coating. The second coating is constructed so as to protect the first coating during vulcanization thereof, the first coating actually vulcanizing in situ during use of the treated geotextile fabric.

The invention also contemplates a composite fabric formed from the geotextile fabric set forth above, connected to a nonwoven filter fabric. The invention also contemplates a method of constructing the treated fabric according to the present invention, and a method of utilizing a geotextile fabric which may include forming the treated fabric described above, attached to the nonwoven filter fabric, into a bag, and filling the bag with sand, grout, or the like during use in the low temperature, harsh environment.

It is the primary object of the present invention to provide a treated fabric which will effectively withstand harsh, abrading, low temperature environments over long periods of time. This and other objects of the invention will become clear from an inspection of the detailed description of the invention, and from the appended claims.

DETAILED DESCRIPTION OF THE DRAWINGS

Figure 1:
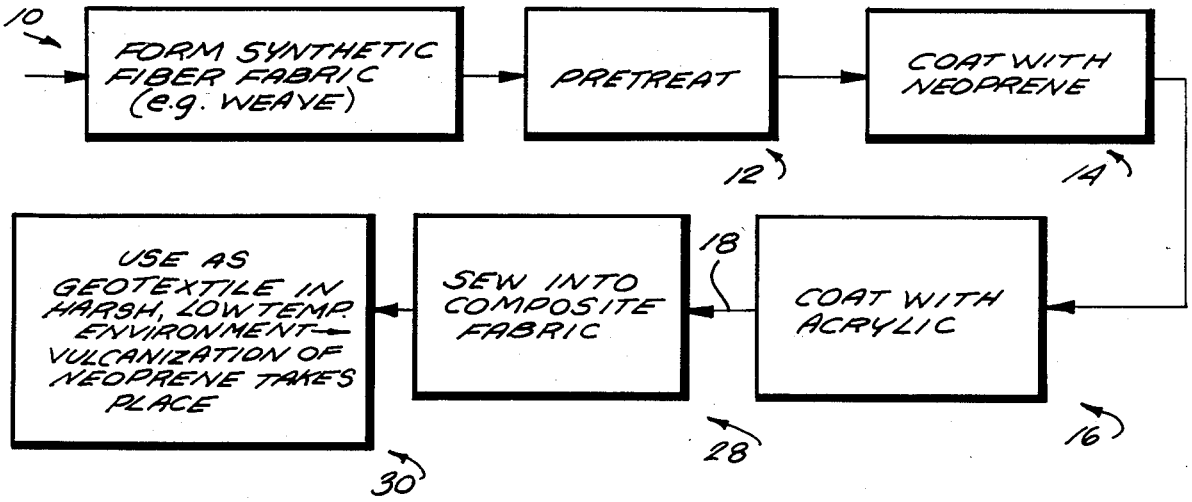
FIG. 1 is a block diagram schematically illustrating various steps utilizable in practicing an exemplary method according to the present invention.

FIG. 1 schematically illustrates method steps that may be practiced according to the present invention to construct, and utilize, a geotextile fabric that has a finish sufficient for it to perform in a harsh, low temperature, abrading environment over a period of many years, exhibiting excellent abrasion, impact, ultraviolet light, and water resistance.

A first step, illustrated generally by reference numeral 10, comprises the forming of a synthetic fiber fabric having a generally open construction. For instance the fabric may be formed by weaving, weft insertion warp knitting, or like suitable known construction mechanisms that result in a strong but generally open construction. The synthetic fiber from which the fabric is formed typically would be nylon or a polyester, although a wide variety of polyesters, polyamides, aramids, and super strength polyethylenes may be utilized.

After formation of the fabric at step 10, the fabric is pretreated at step 12. This pretreating step is desirable in order to ensure that the neoprene coating, to be applied at station 14, properly adheres to the synthetic fibers of the fabric. A wide variety of suitable chemical bonding agents may be utilized for this purpose. For instance the pretreatment may be with an isocyanate resin which is particularly effective in acting as a chemical bonding agent for neoprene to polyester or nylon fabric.

After pretreatment at stage 12, at stage 14 the fabric is coated with a vulcanizable crosslinkable polymer having a highly crystalline structure. Neoprene is an ideal polymer for this purpose. There are a number of different neoprene specialty items that are useful, and which provide a highly crystalline structure. These include, in the descending order of preference, neoprene AD, neoprene AC, neoprene CG, neoprene W, neoprene WHV, neoprene FC, neoprene HC, and neoprene GRT.

It is normally desirable to employ at least 50 percent actual neoprene in the solution with which the neoprene is provided. However suitable loadings and reinforcing materials may be utilized to reduce the amount of neoprene polymer that is necessary. Typical conventional loadings include whiting (calcium carbonate), soft clay, hard clay, furnace type carbon black, and the like. Reinforcement may be provided by the following types of reinforcing carbon black: N-762, N-660, or N-326. Antioxidants preferably are also utilized for good long term aging, and weather resistance. Among the conventional antioxidants that are suitable are included the following: Octamine, antioxidant 2246, naugawhite, and Aranox.

For the purposes of the present invention, a low temperature plasticizer also is highly desirable. The low temperature plasticizer lowers the temperature at which the neoprene becomes brittle. Many organic liquids are suitable for use as low temperature plasticizers, and particularly effective known low temperature plasticizers for use according to the invention include di octyl sebacate, and butyl oleate.

The neoprene solution that is utilized to coat the fabric at stage 14 may also include other components, such as curing agents, processing aids, and the like.

After stage 14, a second highly crystalline, ablative finish, designed to protect the first, neoprene, coating until vulcanization thereof takes place, is applied. The second coating, applied at stage 16, preferably comprises a highly crystalline acrylic coating. For instance the highly crystalline acrylic coating may be provided by any one or more of methyl/acrylate, ethyl/acrylate, and butyl/acrylate. For instance by mixing methyl acrylate and ethyl acrylate the second order transition temperature (Tg) of the crystalline acrylic coating can be varied to a desirable range, and by the addition of butyl acrylate it can be significantly reduced. Other materials may be provided with the methyl acrylate, etc., in order to provide an acceptable coating.

Figure 2:
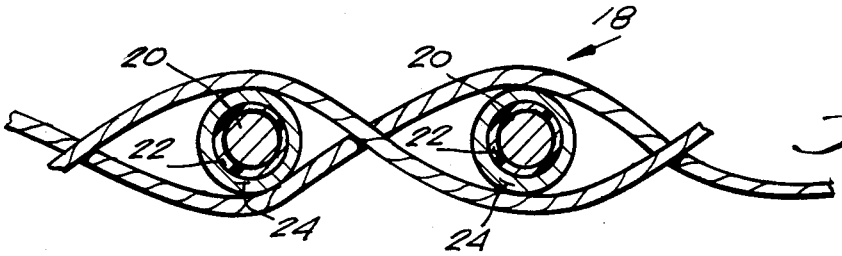
FIG. 2 is a cross-sectional detail view of an exemplary treated fabric according to the present invention.

The treated fabric according to the present invention produced at stages 10 through 16 is illustrated generally by reference numeral 18 in FIG. 2. FIG. 2 schematically illustrates a woven fabric having fibers 20 of nylon, or like synthetic material. The fibers 20 each have a first coating 22 of highly crystalline neoprene, and a second coating 24 of highly crystalline acrylic. Note that the fabric 18 is designed so that vulcanization of the neoprene coating, 22 takes place while the fabric is being used. The ablative acrylic coating 24 protects the neoprene coating 22 until vulcanization has taken place, and the neoprene coating assumes a highly crystalline configuration. The thickness and composition of the acrylic coating 24 is thus designed so that it will wear away completely only after vulcanization, in situ, of the neoprene finish 22 has taken place.

Also according to the present invention, the fabric 18 can be further acted upon so as to facilitate utilization as a geotextile fabric in harsh environments. For instance it can be sewn, or otherwise attached, to other fabric layers to provide a composite fabric, as at stage 28 in FIG. 1. For instance it can be sewn to a layer of synthetic nonwoven filter fabric. Further, as illustrated at stage 30 in FIG. 1, the composite fabric can be formed into a bag designed to hold sand, grout, or the like, or may be formed into another configuration facilitating geotextile use in a harsh environment.

Figure 3:
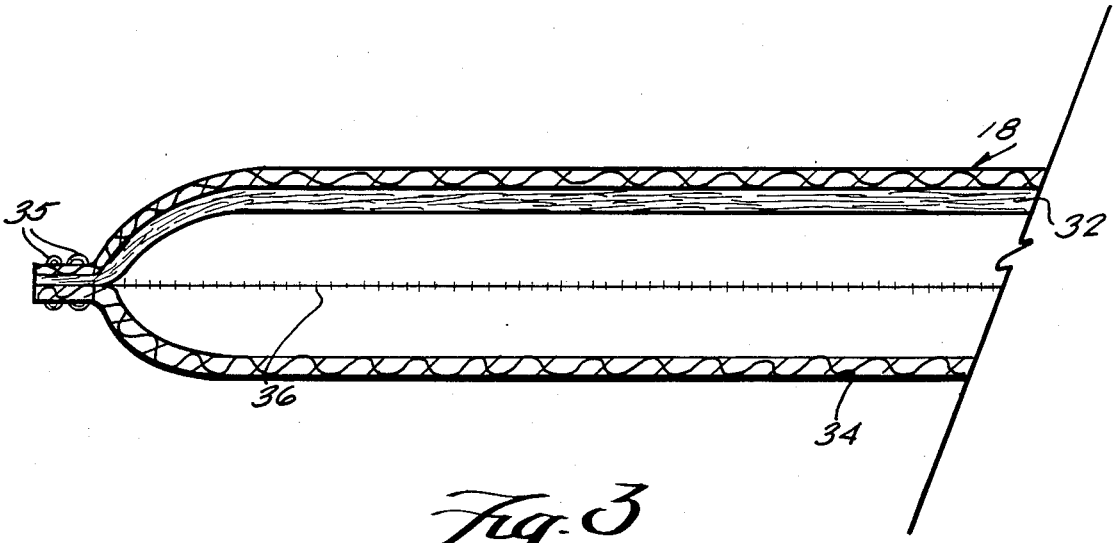
FIG. 3 is a side schematic cross-sectional view of a bag formed utilizing an exemplary composite fabric according to the present invention.

FIG. 3 schematically illustrates one typical utilization of the geotextile fabric 18 according to the present invention. The fabric 18 has been sewn to a nonwoven filter fabric layer 32. That composite fabric has itself been sewn to another fabric 34, and the fabric 34 attached by rear stitches and side stitches 36 to the composite fabric 18, 32 in order to form a bag into which sand, or the like, can be placed. For instance the fabric 34 can be an open polypropylene fabric, such as 3/3 twill that has a high EOS. The fabric 18 will normally face the harsh weather during use, since it is resistant to abrasion, impact, ultraviolet, and water resistance, while the fabric 34 will be on the bottom. Thus the composite fabric 18, 32 forms the top side of the bag in FIG. 3, while the fabric 34 forms the botton side.

Construction of a product, like the bag illustrated FIG. 3, is facilitated since the neoprene will normally be soft above 50° F., facilitating sewing, and like handling operations. However it gets increasingly stiff as the temperature drops below 50° F. The hard acrylic coating offers protection during the sewing operation, as well as during the neoprene curing cycle, and improves the lightfastness, toughness, and oil resistance.

Examples of exemplary neoprene formulations that be utilized to provide the neoprene finish 22 according to the invention are as follows:

EXAMPLE 1

| | Parts by Weight |
|---|---|
| Neoprene AD | 100 |
| Octamine | 2 |
| Red Lead | 20 |
| N-762 | 20 |
| Whiting | 30 |
| Soft Clay | 50 |
| Butyl/Oleate | 9 |

In the above formula, the Octamine acts as an antioxidant, the red lead as a curing agent, the N-762 as reinforcing carbon black, the whiting and soft clay as loading, and the butyl/oleate as a low temperature plasticizer. The Octamine can be provided in a range of 0–5 parts, the red lead in a range of 0–25, the N-762 in the range of 0–100, the whiting in the range of 0–100, the soft clay in the range of 0–100, and the butyl/oleate in the range of 0–20 parts. Some antioxidant and low temperature plasticizer are always preferred.

EXAMPLE 2

| | Parts by Weight |
|---|---|
| Neoprene AD | 100 |
| Antioxidant 2246 | 3.0 |
| Red Lead | 20.0 |
| N-762 | 35.0 |
| Hard Clay | 10.0 |
| Di Octyl Sebacate | 5.0 |

In the above formulation, the hard clay is loading, and the di octyl sebacate is a low temperature platicizer. An effective formulation can be obtained with the antioxidant 2246 in the range of 0–5 parts, the red lead in the range of 0–25, the N-762 in the range 0–100, the hard clay in the range of 0–100, and the di octyl sebacate in the range of 0–20 parts.

The formulations set forth in Examples 1 and 2 relatively quickly achieve the desired high crystallinity. However the same end result of high crystallinity can be obtained by utilizing other types of neoprene. Thus, another example of a formulation for a neoprene finish according to the present invention is set forth below in Example 3, in which the actual formulation, and an appropriate range, are both given:

EXAMPLE 3

| | Parts by Weight | Range (in parts) |
|---|---|---|
| Neoprene GRT | 50.0 | 0–100 |
| Neoprene W-MI | 50.0 | 100–0 |
| Scotchgard "0" | 3.63 | 0–5.0 |
| Antioxidant 2246 | 0.90 | 0–5.0 |
| Naugawhite | 1.80 | 0–5.0 |
| Stearic Acid | 0.90 | 0–1.0 |
| Di Octyl Sebacate | 12.37 | 0–20.0 |
| N-660 | 20.0 | 0–100.0 |
| N-326 | 20.0 | 0–100.0 |
| $CaCO_3$ | 10.48 | 0–25.0 |
| ZNO | 4.57 | 0–5.0 |
| MBTS | 1.19 | 0–5.0 |

The Scotchgard is a processing aid, the naugawhite an antioxidant, the stearic acid a processing aid, the N-660 and N-326 reinforcing carbon blacks, the calcium carbonate a loading (and acid acceptor), and the ZNO and MBTS curing agents.

A typical formulation for the highly crystalline acrylic finish 24 according to the present invention is as follows:

EXAMPLE 4

| | Parts by Weight | Range (in parts) |
|---|---|---|
| Acryloid B-66 | 28.00 | 0–200 |
| Acryloid K-10 | 100.00 | 200–0 |
| Black Pigment | 22.00 | 0–50 |
| Tolo (toluene) | 200.00 | 0–50% |
| Total Mix | 400.00 | |

The Acryloid B-66 is a metyl acrylate, while the acryloid K-10 is an ethyl acrylate. The compound set forth in Example 4 has a Tg of 36° C. By manipulation of the methyl acrylate and ethyl acrylate, the Tg can be varied from 70° C.–20° C. By the addition of butyl acrylate a further reduction in Tg can be obtained.

An isocyanate resin is suitable as a chemical bonding agent. Another chemical bonding agent which will improve the adhesion of the crystalline neoprene compound to the fabric, and also increase abrasion resistance, is 100 parts of the formulation set forth in Example 3, 15 parts of Hyaline M (or PAPI), and 875 parts Tolo. Of course other suitable chemical bonding agents and adhesion promoters may be utilized.

It will thus be seen that according to the present invention a treated fabric suitable for harsh weather, low temperature, abrading environments, a method of producing the fabric, a composite fabric produced utilizing such fabric, and a method of utilizing a geotextile fabric including the treated fabric, have been provided. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and procedures.

What is claimed is:

1. A finished fabric suitable for harsh weather, low temperature, abrading environments, comprising:

a fabric of synthetic material, with a generally open construction;

a first fabric finish for said fabric comprising a vulcanizable cross-linkable polymer having a highly crystalline structure; and a second finish comprising an ablative coating for said first polymer, said second finish also having a highly crystalline structure;

said second finish constructed so as to completely wear away only after the vulcanizable polymer of the first finish has vulcanized.

2. A treated fabric as recited in claim 1 wherein said first fabric finish comprises neoprene.

3. A treated fabric as recited in claim 2 wherein said neoprene includes effective amounts of low temperature plasticizers, antioxidants, and loadings.

4. A treated fabric as recited in claim 3 further comprising a chemical bonding agent for promoting adhesion between said neoprene finish and the synthetic material of said fabric.

5. A treated fabric as recited in claim 4 wherein said chemical bonding agent comprises an isocyanate resin pretreatment for the fabric, applied before said first finish.

6. A treated fabric as recited in claim 5 wherein said second finish comprises an acrylic coating.

7. A treated fabric as recited in claim 6 wherein the synthetic material forming said fabric is selected from the group consisting of polyester, polyamide, aramid, and super polyolefin fibers, and wherein said neoprene coaring is selected from the group consisting of neoprene AD, neoprene AC, neoprene CG, neoprene W, neoprene WHV, neoprene FC, neoprene GRT, and neoprene HC.

8. A treated fabric as recited in claim 1 wherein said first finish comprises a neoprene finish, and wherein said second finish comprises an acrylic finish.

9. A treated fabric as recited in claim 8 wherein said fabric is woven.

10. A treated fabric as recited in claim 8 wherein said fabric is a weft inserted warp knit fabric.

11. A composite fabric comprising at least first and second fabrics, said first fabric comprising a treated fabric comprising a fabric of synthetic material with a generally open construction and having an unvulcanized, vulcanizable first finish comprising a highly crystalline structure neoprene finish, and a second finish comprising an ablative highly crystalline acrylic finish; and a second fabric connected in a layered arrangement with said first fabric and comprising a nonwoven filter fabric.

12. A composite fabric as recited in claim 11 wherein said first fabric is a woven or weft inserted warp knit fabric made of a synthetic material selected from the group consisting essentially of polyamide, polyester, aramid, and super polyolefin fibers, and wherein said first fabric further includes a chemical bonding agent adhesion promoter for facilitating the adhesion of the neoprene to the synthetic fabric.

13. A composite fabric as recited in claim 12 wherein said first fabric neoprene coating includes effective amounts of low temperature plasticizers, antioxidants, and loadings to provide an abrasion, impact, ultraviolet light, and water resistant coating.

14. A method of constructing a treated fabric comprising the steps of:

forming a fabric with a generally open construction of synthetic material;

providing a chemical bonding agent pretreatment of the fabric;

applying an unvulcanized neoprene coating to the fabric, the chemical bonding agent facilitating adhesion of the neoprene coating to the synthetic fibers of the fabric; and applying an ablative acrylic coating to the unvulcanized neoprene coating.

15. A method as recited in claim 14 wherein the steps are practiced so that the vulcanization of the neoprene coating takes place only after the fabric has been put in service, and the acrylic coating does not wear away until vulcanization of the neoprene coating has taken place.

16. A method as recited in claim 15 wherein the fabric forming step is practiced by weaving or weft-insertion warp knitting of the fabric from synthetic fibers selected from the group consisting, polyamides, aramids, and support polyolefin.

17. A method as recited in claim 16 comprising the further step of connecting the treated fabric to a nonwoven filter fabric to form a composite fabric, and forming the composite fabric into a geotextile bag.

18. A method of utilizing a geotextile fabric comprising a synthetic fiber fabric having a generally open construction with a first highly crystalline unvulcanized vulcanizable neoprene coating, and a second ablative acrylic coating over the neoprene coating, comprising the step of exposing the geotextile fabric to a harsh, abrading, low temperature environment so that the unvulcanized vulcanizable neoprene coating vulcanizes during use in the environment, and the acrylic coating does not completely wear away until after vulcanization of the neoprene coating.

19. A method as recited in claim 18 wherein the neoprene coating is soft above 50° F. to facilitate sewing and like handling operations, and becomes increasingly stiff as the temperature drops below 50° F.

20. A method as recited in claim 19 comprising the further step of sewing the geotextile fabric to a nonwoven filter fabric to produce a composite fabric, and sewing the composite fabric into a bag, and filling the bag with sand, grout, or the like during actual use thereof in the harsh environment.

* * * * *